US008279033B2

(12) United States Patent
Irgens

(10) Patent No.: US 8,279,033 B2
(45) Date of Patent: Oct. 2, 2012

(54) TRANSFORMER WITH ISOLATED CELLS

(75) Inventor: O. Stephan Irgens, St. Louis, MO (US)

(73) Assignee: Tech Design, L.L.C., Maryland Heights, MO (US)

( * ) Notice: Subject to any disclaimer, the term of this patent is extended or adjusted under 35 U.S.C. 154(b) by 274 days.

(21) Appl. No.: 12/019,834

(22) Filed: Jan. 25, 2008

(65) Prior Publication Data

US 2009/0189723 A1 Jul. 30, 2009

(51) Int. Cl.
*H01F 27/08* (2006.01)
*H01F 27/02* (2006.01)

(52) U.S. Cl. ..... 336/61; 336/55; 336/90; 336/96

(58) Field of Classification Search ..... 336/55, 336/61, 90, 96
See application file for complete search history.

(56) References Cited

U.S. PATENT DOCUMENTS

| | | | | | |
|---|---|---|---|---|---|
| 3,479,563 | A | | 11/1969 | Roy | |
| 3,539,959 | A | * | 11/1970 | Wildi | 336/60 |
| 3,541,433 | A | * | 11/1970 | Davis | 323/320 |
| 3,691,425 | A | | 9/1972 | Weyrich et al. | |
| 4,004,185 | A | | 1/1977 | Edmondson et al. | |
| 4,095,206 | A | * | 6/1978 | Hishiki | 336/96 |
| 4,151,547 | A | | 4/1979 | Rhoades et al. | |
| 4,292,665 | A | * | 9/1981 | Hersom et al. | 363/141 |
| D351,134 | S | | 10/1994 | Hunziker | |
| 5,359,313 | A | | 10/1994 | Watanabe et al. | |
| 5,479,146 | A | | 12/1995 | Herbert | |
| 5,510,948 | A | | 4/1996 | Tremaine et al. | |
| 5,561,576 | A | | 10/1996 | Baldwin | |
| D378,081 | S | | 2/1997 | Antonczak et al. | |
| D387,333 | S | | 12/1997 | Pellow et al. | |
| 5,710,745 | A | * | 1/1998 | Getreuer | 369/13.23 |
| 5,789,828 | A | | 8/1998 | Tremaine et al. | |
| D414,752 | S | | 10/1999 | Rooyakkers et al. | |
| 6,087,916 | A | * | 7/2000 | Kutkut et al. | 336/61 |
| 6,097,158 | A | | 8/2000 | Manor et al. | |
| 6,392,519 | B1 | * | 5/2002 | Ronning | 336/90 |
| 6,414,291 | B1 | * | 7/2002 | Kim | 219/760 |
| 6,492,890 | B1 | | 12/2002 | Woznlczka | |
| 2005/0052888 | A1 | * | 3/2005 | Takeshima et al. | 363/147 |
| 2005/0088831 | A1 | * | 4/2005 | Lin | 361/752 |

OTHER PUBLICATIONS

PCT International Search Report for PCT/US09/31685 dated Mar. 11, 2009.

* cited by examiner

*Primary Examiner* — Mohamad Musleh
*Assistant Examiner* — Tsz Chan
(74) *Attorney, Agent, or Firm* — Armstrong Teasdale LLP

(57) ABSTRACT

A power transformer apparatus and method of assembling are provided. In one aspect, a method of assembling a transformer is provided. The method includes providing a heat sink including a plurality of exterior ribs, wherein the heat sink forms a bottom wall of an enclosure. The method also includes coupling at least one diaphragm to the heat sink such that a bottom surface of the diaphragm is in contact with the heat sink, coupling at least one winding to the at least one diaphragm, and coupling a terminal board to the heat sink such that a plurality of spacers are positioned between the terminal board and the heat sink.

22 Claims, 7 Drawing Sheets

TRANSFORMER WITH ISOLATED CELLS

BACKGROUND OF THE INVENTION

This invention relates generally to transformers and, more specifically, to low voltage, step-down transformers.

An ideal transformer isolates the input circuit from the output circuit, transforms the input voltage by a ratio of the number of turns in the windings, and is frequency independent. The output voltage is "stepped up" if the secondary coil has more turns than the primary coil. Similarly, if the secondary coil has fewer turns than the primary coil, the voltage will be "stepped down." Additionally, the current will change in an inverse relation to the voltage. Specifically, if the voltage is stepped up across a transformer, the current will be decreased by the same proportion. The power output of a transformer equals the input power less any losses due to factors such as, but not limited to, magnetic imperfections, resistive heating of the transformer windings, and/or mechanical vibrations.

At least some known transformers are negatively affected through heat losses due to factors such as, but not limited to, the resistance of the windings and/or magnetic losses in the form of eddy currents. Additional heat within a transformer enclosure may be created by the connection circuitry. Heat may build up in connections between the coils and the input and output terminals due to natural resistance in the connections, interconnecting wires or cables, and/or any circuit protection devices such as, but not limited to, circuit breakers and/or fuses.

At least some known transformers are cooled using fans within the transformer enclosure. Such a cooling method may add to the expense of assembling and maintaining a transformer, and may also reduce the efficiency of the transformer, due to the additional moving parts and the power requirements. Moreover, such a cooling method may increase the noise associated with the normal operation of a transformer. The use of fans may also increase vibration of the transformer further affecting the efficiency due to mechanical vibration losses and noise generated by the vibrations against a supporting structure.

BRIEF DESCRIPTION OF THE INVENTION

In one aspect, a method of assembling a transformer is provided. The method includes providing a heat sink including a plurality of exterior ribs, wherein the heat sink forms a bottom wall of an enclosure. The method also includes coupling at least one diaphragm to the heat sink such that a bottom surface of the diaphragm is in contact with the heat sink, coupling at least one winding to the at least one diaphragm, and coupling a terminal board to the heat sink such that a plurality of spacers are positioned between the terminal board and the heat sink.

In another aspect, a transformer includes a heat transferal means comprising a plurality of ribs, at least one center hole, and a plurality of extensions comprising a plurality of hanging holes, wherein the heat transferal means forms a bottom wall of a transformer enclosure. The transformer also includes at least one isolation disk, at least one winding comprising a primary coil, a secondary coil, and a core, wherein the winding is coupled to the heat transferal means such that an isolation disk is positioned therebetweeen. The transformer also includes a terminal board coupled to the heat transferal means.

In a further aspect, a step-down transformer for providing low-level output voltage is provided. The step-down transformer includes an enclosure having a heat sink including a plurality of exterior heat-transferring fins. The step-down transformer also includes at least one isolation diaphragm coupled to the heat sink. The step-down transformer also includes at least one transformer winding having a primary coil, a secondary coil, and a toroidal core, wherein the at least one winding is coupled to a diaphragm. The step-down transformer also includes a plurality of spacers and a terminal board coupled to the heat sink such that the spacers are positioned between the terminal board and the heat sink, wherein the terminal board is electrically coupled to the at least one winding using a parallel electrical connection.

DETAILED DESCRIPTION OF THE INVENTION

Figure 1:
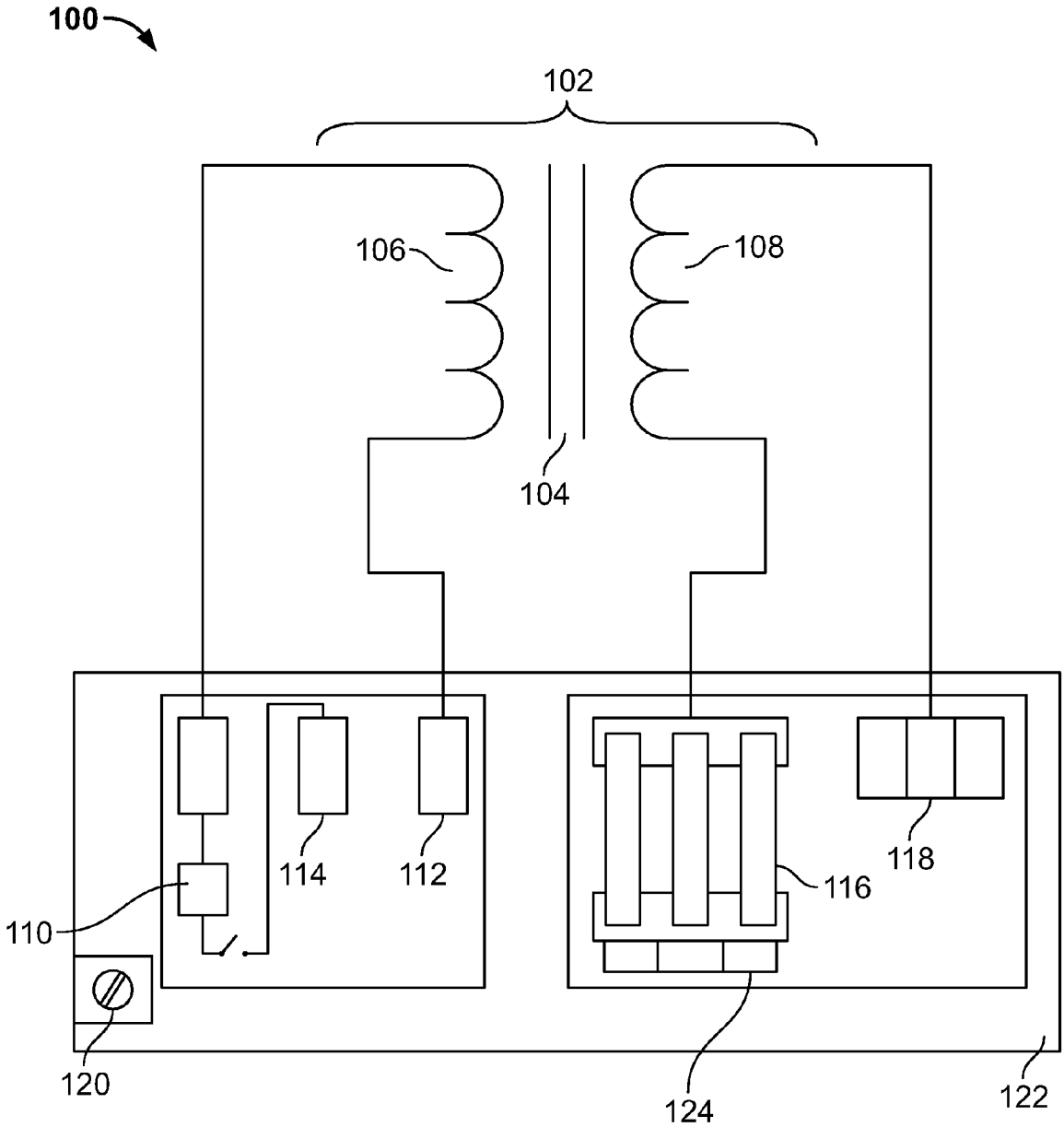
FIG. 1 is a schematic diagram of an exemplary transformer.

FIG. 1 is a schematic diagram of an exemplary transformer 100. Transformer 100 includes at least one winding 102. In the exemplary embodiment, transformer 100 may include from one to three windings 102. The output power of transformer 100 depends directly on the number of windings 102 in transformer 100. For example, and not by way of limitation, transformer 100 having an output of 500W includes one winding 102. Alternative embodiments may include additional windings 102. Each winding 102 includes a toroidal core 104, a primary coil 106, and a secondary coil 108. Primary coil 106 is electrically coupled to a primary circuit breaker 110 and a neutral terminal 112. Circuit breaker 110 is also electrically coupled to an input terminal 114. The electrical rating of circuit breaker 110 depends at least in part on the number of windings 102 included in transformer 100. For example, in one embodiment, transformer 100 with one winding 102 includes a circuit breaker 110 rated for a current of approximately 10 A. Alternative embodiments include a circuit breaker 110 rated for higher or lower current values. In the exemplary embodiment, secondary coil 108 is electrically coupled to a fuse 116 and an output terminal 118. Transformer 100 includes a fuse 116 and an output terminal 118 for each winding 102. In the exemplary embodiment, each fuse 116 is rated for a maximum current of approximately 25 A. Alternative embodiments include a fuse 116 rated for higher or lower current values. Transformer 100 further includes a ground terminal 120.

In the exemplary embodiment, transformer 100 also includes a terminal board 122 which includes the electrical connections described above. Specifically, terminal board 122 includes ground terminal 120, circuit breaker 110, input terminal 114, neutral terminal 112, fuse sockets 116, and output terminals 118. Each primary coil 106 is electrically coupled to circuit breaker 110 and neutral terminal 112. Each secondary coil 108 is electrically coupled to a fuse 116 and an output terminal 118. Circuit breaker 110 is electrically coupled to input terminal 114.

Figure 2:
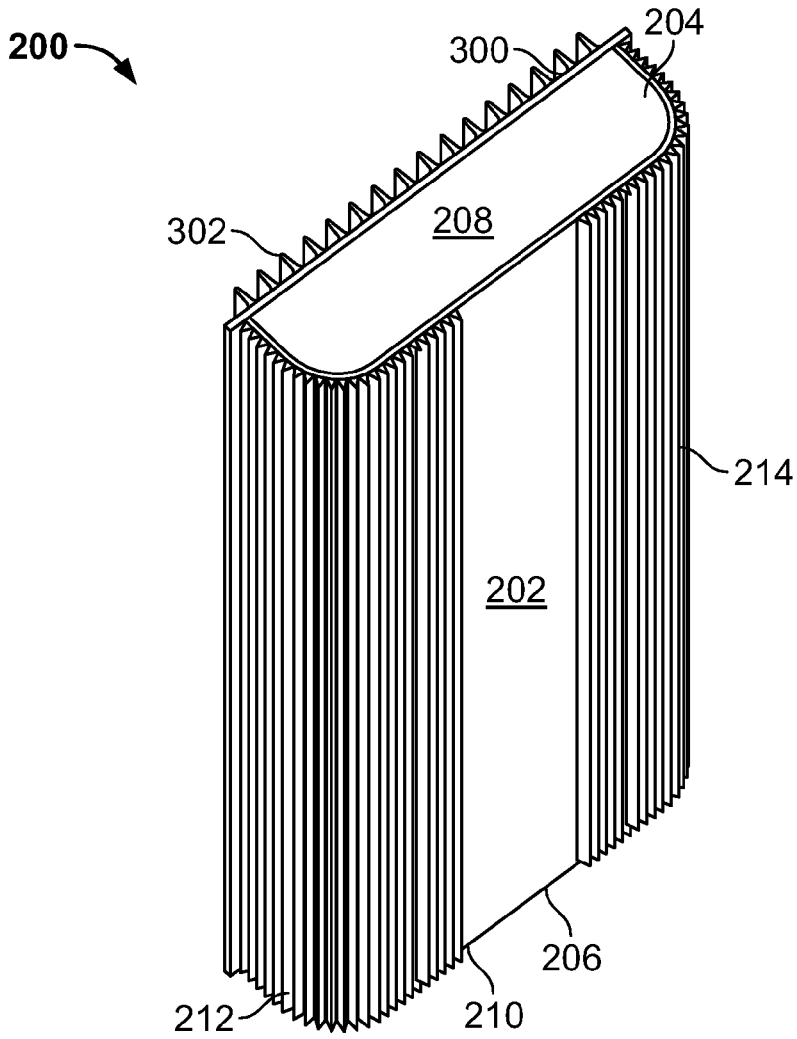
FIGS. 2 and 3 are external diagrams of the exemplary transformer shown in FIG. 1.
Figure 3:
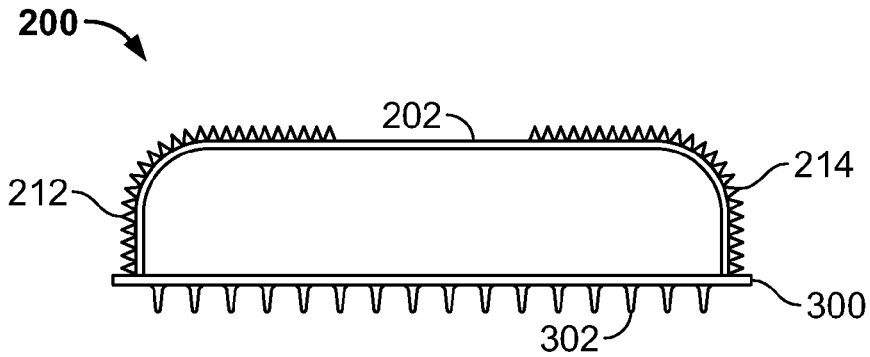

FIGS. 2 and 3 are external diagrams of the exemplary transformer shown in FIG. 1. More specifically, FIG. 2 is a plan view of transformer 100 and FIG. 3 is an end view of transformer 100. As shown in FIGS. 2 and 3, transformer 100 further includes an enclosure 200. In the exemplary embodiment, enclosure 200 is formed from any suitable material, for example, aluminum, an aluminum composite, plastic composites, and the like. The dimensions of enclosure 200 vary according to the number of windings 102 included in transformer 100. Enclosure 200 includes a top wall 202 and an opposing bottom wall 300. In the exemplary embodiment, bottom wall 300 is a heat sink. Enclosure 200 also includes a first end 204 and an opposing second end 206. First end 204 includes a first end wall 208 and second end 206 includes a second end wall 210. In the exemplary embodiment, enclosure 200 defines a complete cover for transformer 100. In one embodiment, the cover defined by enclosure 200 has a U-shaped profile, as shown in FIG. 3. Moreover, enclosure 200 includes a first side wall 212 and an opposing second side wall 214.

Figure 4:
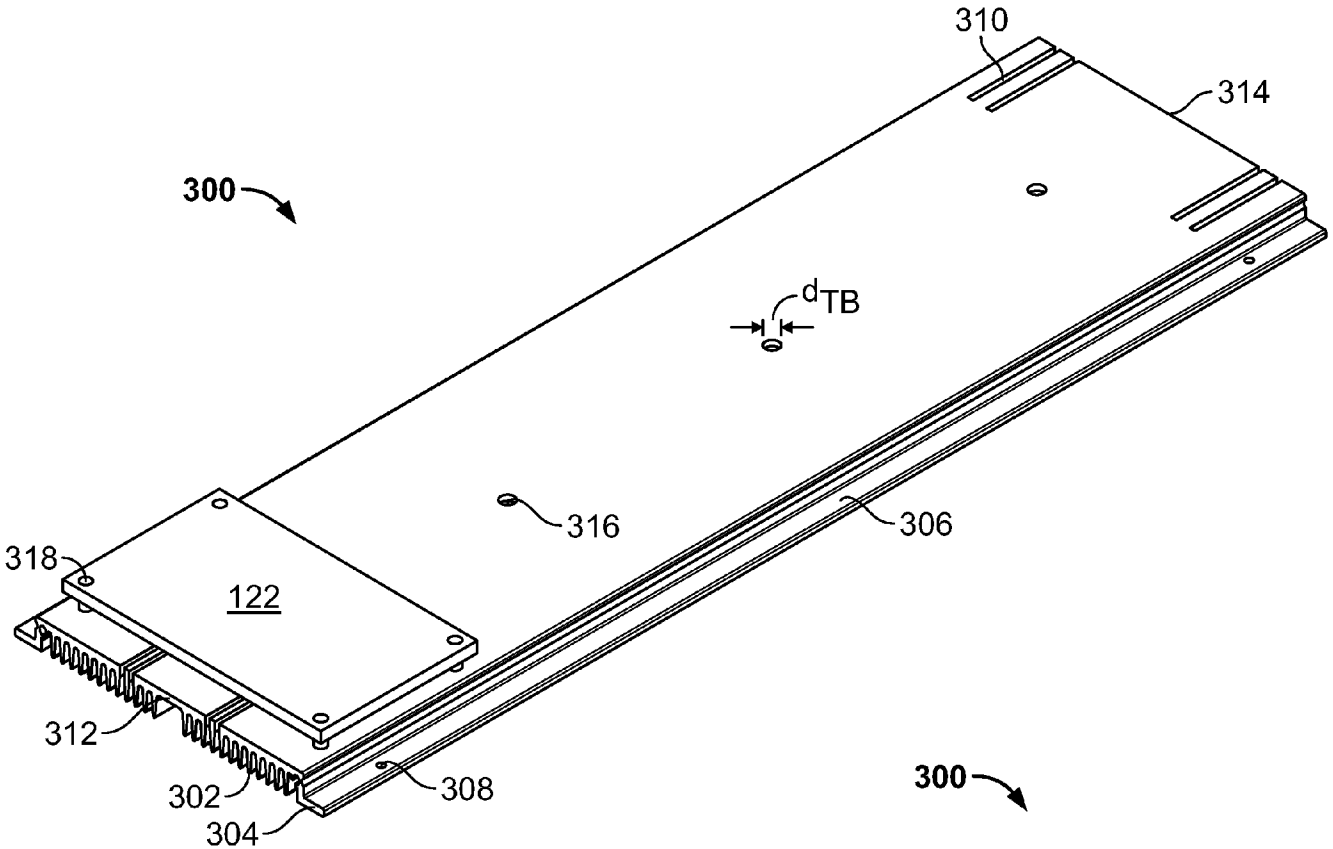
FIG. 4 is a perspective illustration of an exemplary heat sink that may be used in the transformer shown in FIG. 1.

FIG. 4 is a perspective illustration of heat sink 300. In the exemplary embodiment, heat sink 300 is composed of a metal such as, but not limited to, aluminum or an aluminum composite. Alternative embodiments include a heat sink 300 is formed from any suitable material, for example, aluminum, an aluminum composite, plastic composites, and the like. Heat sink 300 includes a plurality of cooling fins 302 on an exterior surface 304. Fins 302 facilitate cooling transformer 100 by conducting heat generated within transformer 100 through heat sink 300 for exposure to cooler, ambient air. Additionally, heat sink 300 includes a mounting flange 306 on each side. Flanges 306 facilitate mounting transformer 100 to a surface such as, but limited to, a wall. Each flange 306 includes at least one mounting hole 308. Holes 308 allow transformer 100 to be mounted by, for example, hanging transformer 100 on a wall or a pair of studs. Holes 308 may also be used to mount transformer 100 on a horizontal surface. Each hole 308 is sized to allow a bolt and/or screw to extend through and into the mounting surface. Heat sink 300 also includes a plurality of vents 310 located in a first end 312 and in an opposite second end 314 of heat sink 300. Vents 310 facilitate additional cooling of transformer 100 by exposing additional surface area to ambient airflow. Heat sink 300 also includes at least one center hole 316. Each center hole 316 is sized to allow, for example, a bolt (not shown) to extend through heat sink 300 in order to affix the at least one winding 102 of transformer 100. As such, each center hole 316 includes a diameter, $d_{TB}$, sized to allow the bolt to pass therethrough.

Figure 5:
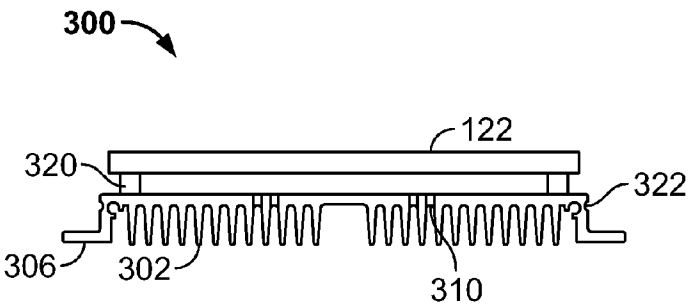
FIG. 5 is an end illustration of the heat sink shown in FIG. 4.

As shown in FIG. 5, a terminal board 122 coupled to heat sink 300. Terminal board 122 includes a plurality of mounting holes 318 such that, for example, a bolt (not shown) extends through a mounting hole 318 and a spacer 320 and into a threaded hole (not shown) in heat sink 300. In the exemplary embodiment, terminal board 122 includes four mounting holes 318 with each mounting hole 318 located at a corner of terminal board 122. Alternative embodiments use different fastening mechanisms. Spacers 320 facilitate allowing air to flow between terminal board 122 and heat sink 300, thereby allowing for additional cooling within transformer 100 when it is fully assembled and operating at load. Additionally, spacers 320 facilitate cooling terminal board 122 to alleviate heat generated in the connections on terminal board 122.

Figure 7:
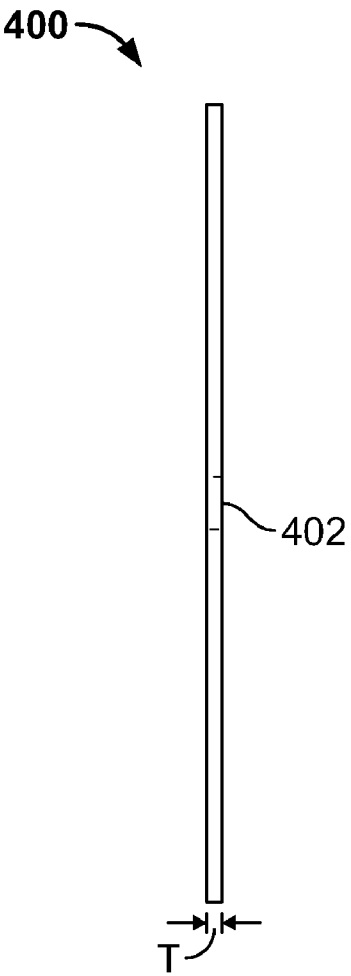
FIG. 7 is a side illustration of the isolation diaphragm shown in FIG. 6.
Figure 6:
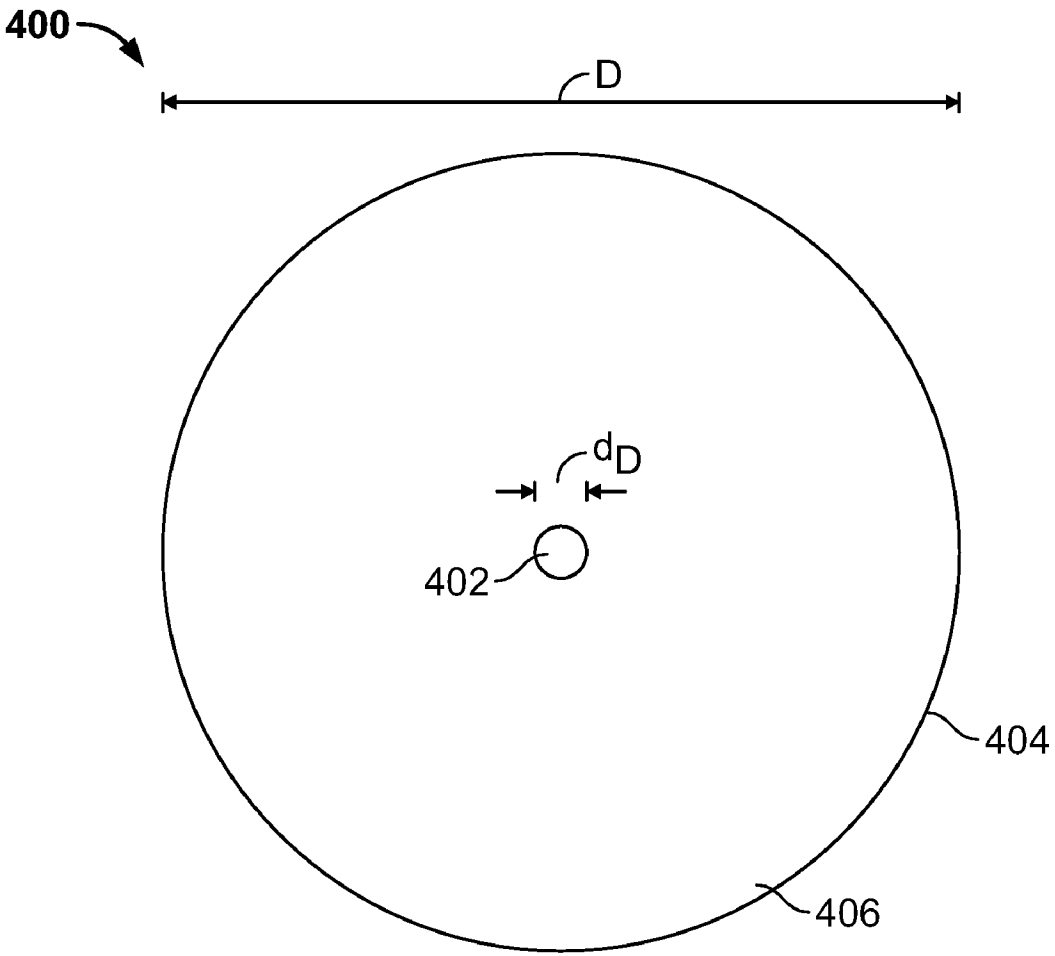
FIG. 6 is a schematic illustration of an exemplary isolation diaphragm that may be used in the transformer shown in FIG. 1.

FIG. 6 is a schematic diagram of an isolation diaphragm 400. In the exemplary embodiment, diaphragm 400 is composed of neoprene. Alternative embodiments include a diaphragm 400 composed of different materials. In the exemplary embodiment, each winding 102 included in transformer 100 is coupled to heat sink 300 (shown in FIG. 4) with a diaphragm 400 therebetween. Diaphragm 400 includes a center hole 402 extending through diaphragm 400 to facilitate coupling a bottom surface 404 of diaphragm 400 to heat sink 300 and a top surface 406 of diaphragm 400 to a winding 102. Each center hole 402 is sized to allow, for example, a bolt (not shown) to extend through heat sink 300 and diaphragm 400 in order to affix the at least one winding 102 of transformer 100. As such, each center hole 402 includes a diameter, $d_D$. In the exemplary embodiment, center hole diameter, $d_D$, of diaphragm 400 is substantially identical to center hole diameter, $d_{TB}$, of heat sink 300. Further, in the exemplary embodiment, diaphragm 400 is shaped as a disk. As such, diaphragm includes a diameter, D. Alternative embodiments may use a differently shaped diaphragm 400. As shown in FIG. 7, diaphragm 400 also includes a thickness, T. In the exemplary embodiment, thickness, T, is pre-determined to facilitate reducing transferal of vibrations generated by normal operation to the mounting surface (not shown), thereby improving the efficiency of transformer 100.

Figure 8:
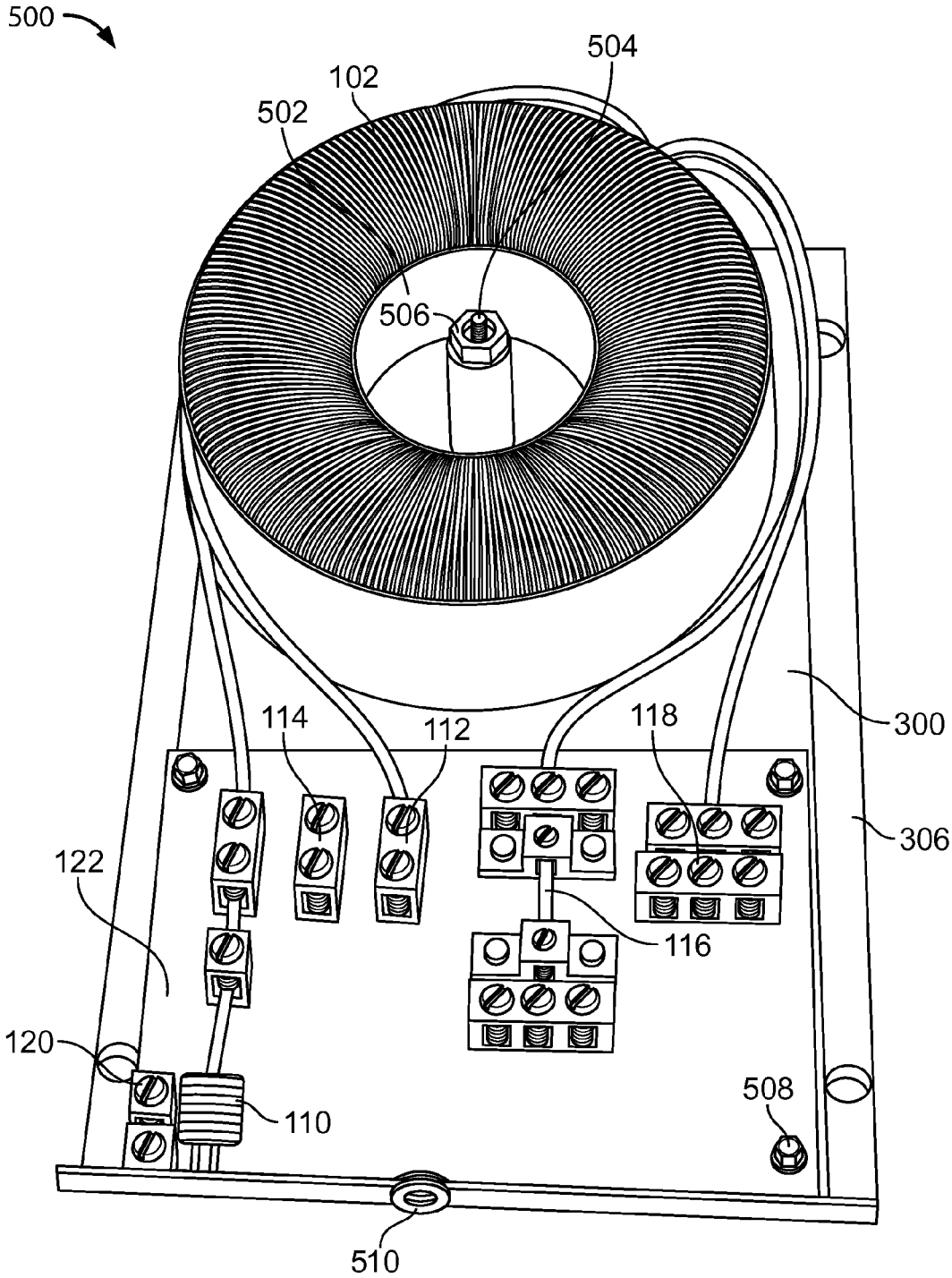
FIG. 8 is an internal view of a single-winding transformer such as those shown in FIGS. 1 and 2.

FIG. 8 is an internal view of a single-winding transformer 500. Transformer 500 includes one winding 102, which includes primary coil 106 and secondary coil 108 surrounding toroidal core 104. The coils are surrounded by a plastic potting 502 that facilitates reducing vibrations within transformer 500. An isolation diaphragm, such as diaphragm 400 (shown in FIG. 6), is coupled between winding 102 and heat sink 300. Diaphragm 400 facilitates reducing vibrations within transformer 500 by absorbing vibrations created by, for example, winding 102. Winding 102 is coupled to heat sink 300 by bolt 504 extending through a hole (not shown) in each of heat sink 300 and diaphragm 400. Bolt 504 further extends through winding 102 and attaches to a threaded nut 506. Alternative embodiments use other coupling methods to secure winding 102 to heat sink 300 such as, but not limited to, bolt 504 extending through winding 102 and diaphragm 400 and secured in a threaded hole in heat sink 300.

FIG. 8 also shows a terminal board 122. Terminal board 122 includes a plurality of mounting holes 318 (shown in FIG. 4). Terminal board 122 is coupled to heat sink 300 by a plurality of bolts 508 extending through terminal board 122. In the exemplary embodiment, a bolt 508 at each corner of terminal board 122 extends through a mounting hole 318 and a spacer 320 (shown in FIG. 5), and is inserted into a threaded hole (not shown) in heat sink 300. Alternative embodiments use a different method of fixing terminal board 122 to heat sink 300. Terminal board 122 also includes a circuit breaker 110, ground terminal 120, input terminal 114, and neutral terminal 112, as described above. Terminal board 122 also includes a secondary circuit fuse 116 and an output terminal 118. Input and output power cables (not shown) are passed through a wire channel 510 and are connected to input terminal 114, neutral terminal 112, and/or output terminal 118 within transformer 500. Heat sink 300 includes at least one mounting flange 306. In the exemplary embodiment, heat sink 300 includes two mounting flanges 306, and each flange 306 includes two mounting holes 308. Holes 308 allow transformer 500 to be hung on a wall or secured to another flat surface.

Figure 9:
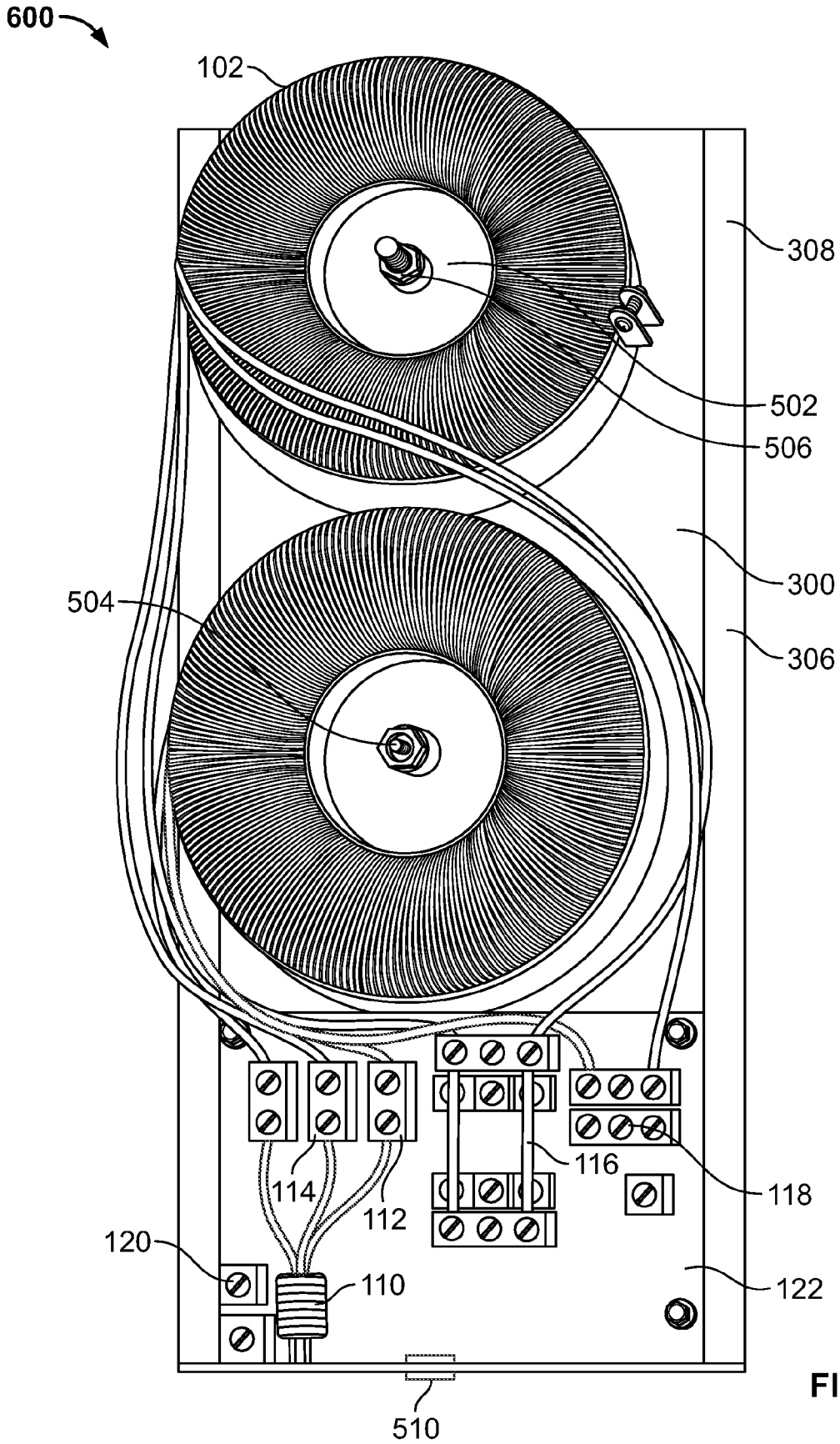
FIG. 9 is an internal view of a dual-winding transformer such as those shown in FIGS. 1 and 2.

FIG. 9 is an internal view of a dual-winding transformer such as those shown in FIGS. 1-3. Transformer 600 includes two windings 102, each of which includes primary coil 106 and secondary coil 108 surrounding toroidal core 104. The coils are surrounded by a plastic potting 502 that facilitates reducing vibrations within transformer 600. An isolation diaphragm, such as diaphragm 400 (shown in FIG. 6), is coupled between each winding 102 and heat sink 300. Diaphragms 400 facilitate reducing vibrations within transformer 600 by absorbing vibrations created by, for example, windings 102. In the exemplary embodiment, each diaphragm 400 is composed of primarily neoprene. Alternative embodiments may use other materials. Each winding 102 is coupled to heat sink 300 by a bolt 504 extending through a hole (not shown) in each of heat sink 300 and diaphragm 400. Each bolt 504 further extends through each winding 102 and attaches to a threaded nut 506. Alternative embodiments use other coupling methods to secure windings 102 to heat sink 300 such as, but not limited to, a bolt 504 extending through each winding 102 and diaphragm 400 and secured in a threaded hole in heat sink 300.

FIG. 9 also shows a terminal board 122. Terminal board 122 includes a plurality of mounting holes, such as mounting hole 318 (shown in FIG. 4). Terminal board 122 is coupled to heat sink 300 by a plurality of bolts 508 extending through terminal board 122. In the exemplary embodiment, a bolt 508 at each corner of terminal board 122 extends through a mounting hole 318 and a spacer 320 (shown in FIG. 5), and is inserted into a threaded hole (not shown) in heat sink 300. Alternative embodiments use a different method of fixing terminal board 122 to heat sink 300. Terminal board 122 also includes circuit breaker 110, ground terminal 120, input terminal 114, and neutral terminal 112, as described above. Terminal board 122 also includes two secondary circuit fuses 116 and an output terminal 118. Input and output power cables (not shown) are passed through a cable channel 510 and are connected to input terminal 114, neutral terminal 112, and/or output terminal 118 within transformer 600. Heat sink 300 includes at least one mounting flange 306. In the exemplary embodiment, heat sink 300 includes two mounting flanges 306, and each flange 306 includes two mounting holes 308. Holes 308 allow transformer 600 to be hung on a wall or secured to another flat surface.

Figure 10:
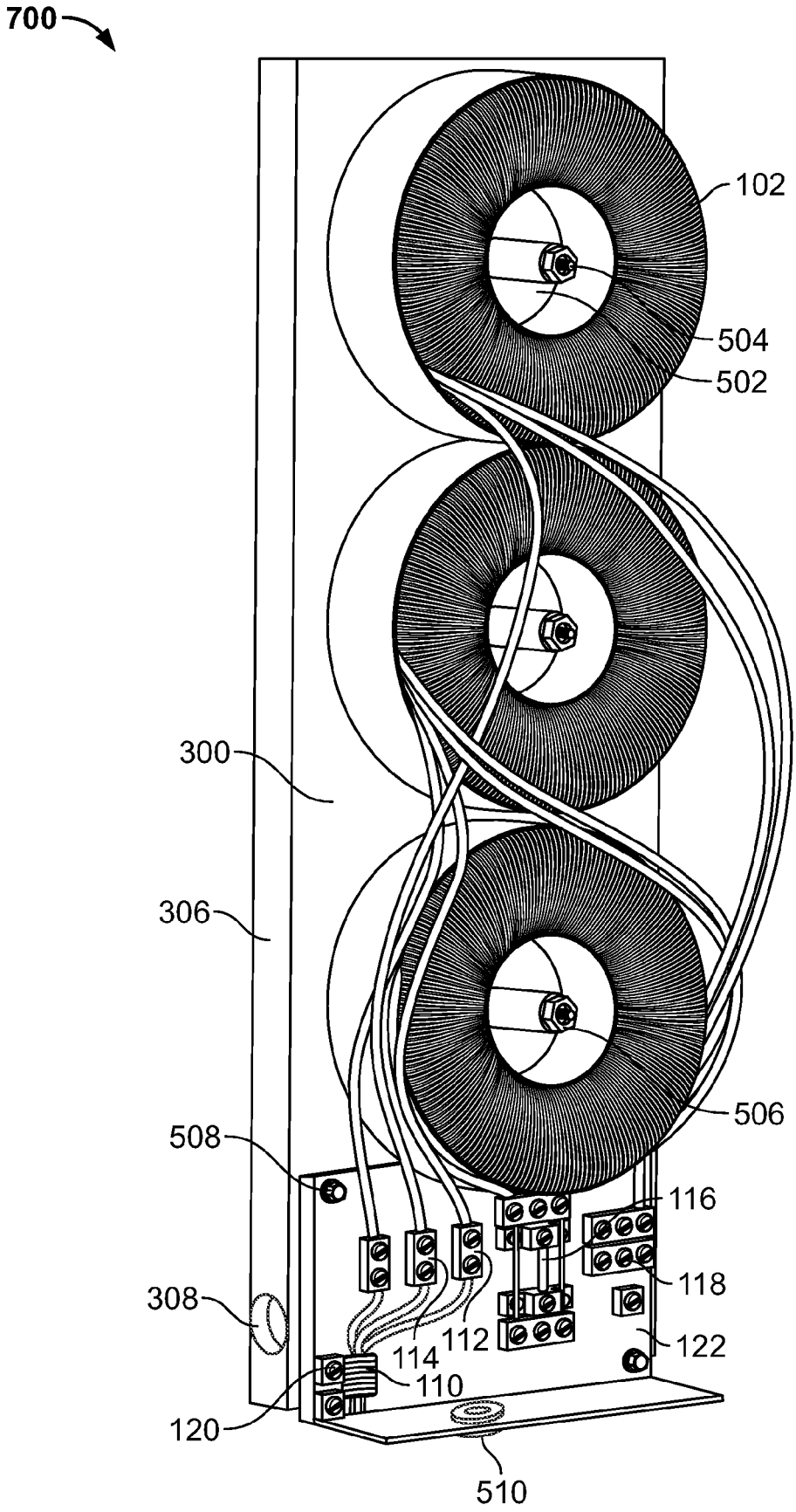
FIG. 10 is an internal view of a triple-winding transformer such as those shown in FIGS. 1 and 2.

FIG. 10 is an internal view of a triple-winding transformer such as those shown in FIGS. 1-3. Transformer 700 includes three windings 102, each of which includes primary coil 106 and secondary coil 108 surrounding toroidal core 104. The coils are surrounded by a plastic potting 502 that facilitates reducing vibrations within transformer 700. An isolation diaphragm, such as diaphragm 400 (shown in FIG. 6), is coupled between each winding 102 and heat sink 300. Diaphragms 400 facilitate reducing vibrations within transformer 700 by absorbing vibrations created by, for example, windings 102. In the exemplary embodiment, each diaphragm 400 is composed of primarily neoprene. Alternative embodiments use other materials. Each winding 102 is coupled to heat sink 300 by a bolt 504 extending through a hole (not shown) in each of heat sink 300 and diaphragm 400. Each bolt 504 further extends through each winding 102 and attaches to a threaded nut 506. Alternative embodiments use other coupling methods to secure windings 102 to heat sink 300 such as, but not limited to, a bolt 504 extending through each winding 102 and diaphragm 400 and secured in a threaded hole in heat sink 300.

FIG. 10 also shows a terminal board 122. Terminal board 122 includes a plurality of mounting holes 318 (shown in FIG. 4). Terminal board 122 is coupled to heat sink 300 by a plurality of bolts 508 extending through terminal board 122. In the exemplary embodiment, a bolt 508 at each corner of terminal board 122 extends through a mounting hole 318 and a spacer 320 (shown in FIG. 5), and is inserted into a threaded hole (not shown) in heat sink 300. Alternative embodiments may use a different method of fixing terminal board 122 to heat sink 300. Terminal board 122 also includes circuit breaker 110, ground terminal 120, input terminal 114, and neutral terminal 112, as described above. Terminal board 122 also includes three secondary circuit fuses 116 and an output terminal 118. Input and output power cables (not shown) are passed through a cable channel 510 and are connected to input terminal 114, neutral terminal 112, and/or output terminal 118 within transformer 700. Heat sink 300 includes at least one mounting flange 306. In the exemplary embodiment, heat sink 300 includes two mounting rails flange 306, and each flange 306 includes two mounting holes 308. Holes 308 allow transformer 700 to be hung on a wall or secured to another flat surface.

During operation, and referring to FIG. 8, an input source is electrically coupled to input terminal 114, such that a current flows through an input power cable (not shown) and into input terminal 114. The input source is also electrically coupled to neutral terminal 112. Current flows through a circuit protection device such as circuit breaker 110, for example. If the current level is higher than a predetermined rating of circuit breaker 110, then circuit breaker 110 trips and the circuit is opened to facilitate preventing damage to transformer 500 and the surrounding environment. If the current level is less than the predetermined rating of circuit breaker 110, the current then flows into one or more primary coils 106. The current flowing through a primary coil 106 produces a magnetic field within an associated core 104. The magnetic field in turn induces a voltage across secondary coil 108. In the exemplary embodiment, transformer 500 is a step-down transformer meaning that the output voltage is less than the input voltage and, further, that the output current is greater than the input current. The ratio of the primary and secondary voltages is a constant for transformer 500, wherein the ratio depends on the number of turns of wire present in each of the primary coil 106 and the secondary coil 108.

As described above, transformers, such as transformer 500, are subject to energy losses from a number of factors such as, but not limited to, mechanical losses (e.g., vibrations within the windings and/or housing) and/or heat losses. Referring to FIG. 8, transformer 500 includes a plastic potting 502 surrounding the primary coil 106, secondary coil 108, and core 104 of winding 102. Moreover, transformer 500 includes an isolation diaphragm 400 (shown in FIG. 6). Potting 502 and diaphragm 400 absorb vibrations within transformer 500, thereby preventing mechanical losses within transformer 500 and preventing transferal of vibrations to the surrounding environment such that the noise level is lessened during normal operation.

Transformer 500 also includes a plurality of ribs or fins 302 (shown in FIG. 4) on the exterior of heat sink 300. Fins 302 facilitate exposing a greater surface area of heat sink 300 to ambient air, thereby increasing the heat exchange ability of transformer 500. Moreover, transformer 500 also includes a corrugated exterior surface of enclosure 200 that facilitates exposing additional surface area of enclosure 200 to ambient air, further increasing the heat exchange ability of transformer 500. Additionally, transformer 500 includes a plurality of spacers 320 positioned between terminal board 122 and heat sink 300. Spacers 320 facilitate allowing air flow between terminal board 122 and heat sink 300. Increased air flow facilitates lowering the temperature of the air exposed to heat sink 300 such that the heat to be dissipated through heat sink 300 is lessened.

The above-described apparatus permit reductions in noise, heat, and vibration in a power transformer. Specifically, a heat sink that includes exterior fins facilitates cooling the transformer without the need for interior fans or other cooling methods. Eliminating such fans facilitates reducing noise generated by the transformer during normal operation. An isolation pad coupled between each winding and the heat sink facilitates reducing vibrations created during normal operation. A reduction in vibrations external to the transformer further facilitates reducing noise generated by the transformer. Moreover, coupling a terminal board to the heat sink facilitates reducing heat buildup in the connections.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the invention has been described in terms of various specific embodiments, those skilled in the art will recognize that the invention can be practiced with modification within the spirit and scope of the claims.

What is claimed is:

1. A method of assembling a transformer, said method comprising:

providing a heat sink including a plurality of exterior ribs, wherein the heat sink forms a bottom wall of an enclosure;

removably coupling at least one diaphragm to the heat sink such that a bottom surface of the diaphragm is in contact with the heat sink, wherein the diaphragm facilitates reducing transferal of vibrations generated by the transformer to the enclosure;

removably coupling at least one winding to a top surface of the at least one diaphragm; and coupling a terminal board to the heat sink adjacent the at least one winding such that a plurality of spacers are positioned between the terminal board and the heat sink.

2. A method in accordance with claim 1 wherein coupling at least one winding to the at least one diaphragm comprises coupling at least one winding to a top surface of the at least one diaphragm, and wherein each winding includes a primary coil, a secondary coil, a core, and a plastic potting surrounding the primary coil, secondary coil, and core.

3. A method in accordance with claim 1 further comprising coupling at least one circuit protection device to the terminal board.

4. A method in accordance with claim 3 wherein coupling at least one circuit protection device to the terminal board comprises:

electrically coupling a circuit breaker to a primary coil; and electrically coupling at least one fuse to a secondary coil.

5. A method in accordance with claim 1 wherein providing the heat sink further comprises providing a heat sink including a plurality of vents defined within each of a first end of the heat sink and a second end of the heat sink.

6. A method in accordance with claim 1 further comprising electrically coupling the at least one winding to the terminal board using a parallel electrical connection.

7. A transformer comprising:

a heat transferal means comprising a plurality of ribs, at least one center hole, and a plurality of mounting flanges configured for mounting said transformer to a surface and comprising a plurality of mounting holes, wherein said heat transferal means forms a bottom wall of a transformer enclosure;

at least one isolation disk affixed to said heat transferal means with a bottom surface of said at least one isolation disk coupled to said heat transferal means;

at least one winding comprising a toroidal core, a primary coil surrounding the toroidal core, and a secondary coil surrounding the toroidal core, said winding coupled to said heat transferal means by a bolt extending through said heat transferal means, said isolation disk, and said at least one winding at a first location such that said isolation disk is positioned between said at least one winding and said heat transferal means; and a terminal board comprising an input terminal and an output terminal, said terminal board coupled to said heat transferal means at a second location that is different than the first location.

8. A transformer in accordance with claim 7 wherein said at least one winding further comprises a plastic potting surrounding said primary coil, said secondary coil, and said core.

9. A transformer in accordance with claim 7 further comprising a circuit protection means coupled to said terminal board, said circuit protection means comprising a circuit breaker and at least one fuse.

10. A transformer in accordance with claim 9 wherein said circuit breaker is electrically coupled to said primary coil.

11. A transformer in accordance with claim 9 wherein said at least one fuse is electrically coupled to said secondary coil.

12. A transformer in accordance with claim 7 wherein said heat transfer means further comprises a first end, an opposing second end, and a plurality of openings in each of said first and second ends.

13. A transformer in accordance with claim 7 wherein said at least one winding is electrically coupled to said terminal board using a parallel electrical connection.

14. A transformer in accordance with claim 7 further comprising a plurality of spacers positioned between said terminal board and said heat transferal means.

15. A step-down transformer for providing low-level output voltage, said transformer comprising:

an enclosure comprising a heat sink comprising a plurality of exterior heat-transferring fins;

at least one isolation diaphragm composed of a flexible material, said diaphragm removably affixed to said heat sink such that a bottom surface of said diaphragm is in contact with said heat sink;

at least one transformer winding comprising a primary coil, a secondary coil, and a toroidal core, said at least one winding removably coupled to a top surface of said diaphragm to facilitate reducing transferal of vibrations generated by said at least one transformer to said enclosure;

a plurality of spacers; and a terminal board coupled to said heat sink adjacent said at least one transformer Winding such that said spacers are positioned between said terminal board and said heat sink, wherein said terminal board is electrically coupled to said at least one winding using a parallel electrical connection.

16. A step-down transformer in accordance with claim 15 wherein said heat sink further comprises a plurality of mounting flanges each comprising a plurality of mounting holes.

17. A step-down transformer in accordance with claim 15 wherein said at least one winding further comprises a plastic potting surrounding said primary coil, said secondary coil, and said core.

18. A step-down transformer in accordance with claim 15 further comprising at least one circuit protection device coupled to said terminal board.

19. A step-down transformer in accordance with claim 18 wherein said at least one circuit protection device comprises a circuit breaker and at least one fuse.

20. A step-down transformer in accordance with claim 15 wherein said heat sink further comprises a plurality of vents formed in each of a first end of said heat sink and an opposite second end of said heat sink.

21. A transformer in accordance with claim 7 wherein said at least one isolation disk is composed of a flexible material.

22. A transformer in accordance with claim 21 wherein the flexible material comprises neoprene.

* * * * *